US009734781B2

(12) United States Patent
Syu

(10) Patent No.: US 9,734,781 B2
(45) Date of Patent: Aug. 15, 2017

(54) GAMMA CURVE ADJUSTING METHOD AND ADJUSTING DEVICE FOR TFT-LCD TO ADDRESS PROBLEMS CAUSED BY UNEVEN GAMMA CURVE

(71) Applicant: SHENZHEN CHINA STAR OPTOELECTRONICS TECHNOLOGY CO., LTD., Shenzhen, Guangdong (CN)

(72) Inventor: Shen-Sian Syu, Shenzhen (CN)

(73) Assignee: Shenzhen China Star Optoelectronics Technology Co., LTD. (CN)

( * ) Notice: Subject to any disclaimer, the term of this patent is extended or adjusted under 35 U.S.C. 154(b) by 0 days.

(21) Appl. No.: 14/240,389

(22) PCT Filed: Jan. 20, 2014

(86) PCT No.: PCT/CN2014/070909

§ 371 (c)(1),
(2) Date: Feb. 22, 2014

(87) PCT Pub. No.: WO2015/096240

PCT Pub. Date: Jul. 2, 2015

(65) Prior Publication Data

US 2015/0179116 A1 Jun. 25, 2015

(30) Foreign Application Priority Data

Dec. 25, 2013 (CN) ..... 2013 1 0728274

(51) Int. Cl.
*G09G 3/36* (2006.01)

(52) U.S. Cl.
CPC ... *G09G 3/3648* (2013.01); *G09G 2320/0276* (2013.01); *G09G 2320/0673* (2013.01); *G09G 2360/145* (2013.01)

(58) Field of Classification Search
CPC ... G09G 2320/0673; G09G 2320/0693; G09G 3/3648
See application file for complete search history.

(56) References Cited

U.S. PATENT DOCUMENTS

2005/0206636 A1* 9/2005 Kanai ..... G09G 3/2081 345/204
2009/0231256 A1* 9/2009 Kim ..... G09G 3/3648 345/89
2014/0139571 A1* 5/2014 Albrecht ..... G09G 5/02 345/694

FOREIGN PATENT DOCUMENTS

CN 101071536 A 11/2007
CN 101231830 A 7/2008
(Continued)

OTHER PUBLICATIONS

International Search Report mailed May 26, 2014, issued to International Application No. PCT/CN2014/071386.

*Primary Examiner* — Lisa Landis
(74) *Attorney, Agent, or Firm* — Kim Winston LLP

(57) ABSTRACT

The present disclosure provides a method and a device for adjusting a Gamma curve of TFT-LCD. The method comprises steps of: capturing grayscale images of the TFT-LCD to be tested which are displayed under a series of specific grayscale voltages; calculating grayscale information corresponding to the images according to the captured grayscale images, so as to obtain a Gamma curve; determining an uneven area in the Gamma curve based on the grayscale information corresponding to two adjacent grayscale voltages; calculating depth of the uneven area; and adjusting amplitude of any one or both of the two adjacent grayscale voltages based on the depth so that the Gamma curve between the two adjacent grayscale voltages is even. The present disclosure can improve the Gamma curve, thus
(Continued)

eliminating the display color cast or the brightness abnormity.

18 Claims, 4 Drawing Sheets

(56) References Cited

FOREIGN PATENT DOCUMENTS

| | | | |
|---|---|---|---|
| CN | 101908329 | A | 12/2010 |
| JP | 4745107 | B2 | 8/2011 |

* cited by examiner

GAMMA CURVE ADJUSTING METHOD AND ADJUSTING DEVICE FOR TFT-LCD TO ADDRESS PROBLEMS CAUSED BY UNEVEN GAMMA CURVE

FIELD OF THE INVENTION

The present disclosure relates to the field of liquid crystal display technologies, and particularly, to a method and device for adjusting Gamma curve of TFT-LCD liquid crystal display.

BACKGROUND OF THE INVENTION

With regard to a liquid crystal display (LCD), an input voltage signal will generate brightness output on a screen, but the brightness of liquid crystal is not in direct proportion to the input voltage signal, which results in that the image has a distortion. If the input voltage signal is a black-and-white image signal, the distortion will cause the middle tone of the displayed image to be dark, thus the whole image is darker than the original scene. Here, Gamma value is a parameter for measuring the distortion. However, no matter what brand the liquid crystal panel is, the Gamma value is almost a constant due to the consistency of physical principles.

Due to the Gamma distortion, the image represented by the input voltage signal will be darker than the original image in case of being displayed on the screen, the image cannot be directly used, and the distortion needs to be corrected. With regard to a specific LCD, the Gamma value is constant. Therefore, the Gamma curve can only be adjusted by changing a plurality of groups of different gray voltages in the input voltage signal, as shown in FIG. 1. Aiming at the specifications required by customers, the target Gamma curve to be achieved is set, as shown in FIG. 2.

However, due to the instability of LCD manufacturing procedures, the adjusted Gamma curve may not be ideal, for example, an uneven curve may be obtained. As shown in FIG. 3, an uneven area 301 occurs between the points corresponding to input voltages V1 and V2. The uneven Gamma curve obtained after correction will cause display color cast or brightness abnormity. The display color cast or the brightness abnormity is not expected.

Therefore, there is a need to provide a method for adjusting Gamma curve to make the adjusted Gamma curve more even and thus eliminate the problem of color cast or brightness abnormity caused by the uneven Gamma curve.

SUMMARY OF THE INVENTION

In order to solve the above-mentioned technical problems, the present disclosure provides a method for adjusting a Gamma curve of TFT-LCD, comprising steps of:

capturing grayscale images of the TFT-LCD to be tested which are displayed under a series of specific grayscale voltages;

calculating grayscale information corresponding to the images according to the captured grayscale images, so as to obtain a Gamma curve;

determining an uneven area in the Gamma curve based on the grayscale information corresponding to two adjacent grayscale voltages;

calculating depth of the uneven area; and adjusting amplitude of any one or both of the two adjacent grayscale voltages based on the depth so that the Gamma curve between the two adjacent grayscale voltages is even.

According to the method of the present disclosure, the grayscale information in the grayscale images displayed under a series of the specific grayscale voltages comprises brightness output values corresponding to 0-255 grayscale voltages.

According to the method of the present disclosure, the step of determining the uneven area in the Gamma curve based on the grayscale information of the two adjacent grayscale voltages comprises determining the uneven area based on whether a slope of the Gamma curve between the two adjacent grayscale voltages changes in polarity or not.

According to an example of the present disclosure, the amplitude of the smaller one of the two adjacent grayscale voltages is adjusted, so that the slope of the Gamma curve between the two adjacent grayscale voltages have no change in its polarity.

According to an example of the present disclosure, the amplitude of the smaller one of the two adjacent grayscale voltages is adjusted, so that brightness output value generated accordingly equals to the original brightness output value plus the multiples of the depth value, and thus the slope of the Gamma curve between the two adjacent grayscale voltages have no change in its polarity.

According to another aspect of the present disclosure, a Gamma curve adjustment device for a TFT-LCD is further provided, comprising: a photodetector for capturing the grayscale images of the TFT-LCD displayed under a series of specific grayscale voltages; a micro control unit communicatively connected with the photodetector for performing the following operations: calculating grayscale information corresponding to the images according to the captured grayscale images, so as to obtain a Gamma curve; determining an uneven area in the Gamma curve based on the grayscale information corresponding to two adjacent grayscale voltages; calculating depth of the uneven area; and adjusting the amplitude of any one or both of the two adjacent grayscale voltages based on the depth so that the Gamma curve between the two adjacent grayscale voltages is even; and a programming voltage buffer connected with the micro control unit, for receiving and storing the adjusted grayscale voltage value so as to provide the adjusted grayscale voltage value to a source driver circuit which is used for outputting the grayscale voltage.

According to an example of the present disclosure, the grayscale information in the grayscale images displayed under a series of the specific grayscale voltages comprises brightness output values aiming at 0-255 grayscale voltages.

According to an example of the present disclosure, determining the uneven area in the Gamma curve based on the grayscale information of the two adjacent grayscale voltages comprises determining the uneven area based on whether the slope of the Gamma curve between the two adjacent grayscale voltages change its polarity or not.

According to an example of the present disclosure, the amplitude of the smaller one of the two adjacent grayscale voltages is adjusted, so that the slope of the Gamma curve between the two adjacent grayscale voltages have no change in its polarity.

According to an example of the present disclosure, the amplitude of the smaller one of the two adjacent grayscale voltages is adjusted, so that brightness output value generated accordingly equals to the original brightness output value plus the multiples of the depth value, and thus the slope of the Gamma curve between the two adjacent grayscale voltages have no change in its polarity.

According to an example of the present disclosure, in order to ensure the accuracy of the image acquired by the photodetector, the micro control unit, the photodetector, the programming voltage buffer and the liquid crystal display to be tested are arranged in a dark box.

In order to improve the integration degree of the present disclosure, the micro control unit can be arranged in the master control circuit board of the liquid crystal display to be tested.

The present disclosure has the beneficial effect that the stable degree of the adjusted Gamma curve can be improved, a source driver voltage corresponding to the curve needing to be adjusted is determined by virtue of the uneven depth in the Gamma curve obtained by an optical measurement system, and then the circumstance of slope polarity change occurring in the Gamma curve is eliminated, thus improving the display color cast phenomenon or the brightness abnormity phenomenon.

Other features and advantages of the present disclosure will be described below in conjunction with the accompanying drawings and embodiments. The objectives of the present disclosure and other advantages can be obtained or achieved by means of the structures or methods as illustrated in detail in the description and claims.

BRIEF DESCRIPTION OF THE DRAWINGS

The accompanying drawings are provided for a further understanding of the present disclosure, constitute a part of the description, and are used for interpreting the present disclosure together with the embodiments of the present disclosure, rather than limiting the present disclosure. In the accompanying drawings.

DETAILED DESCRIPTION OF THE EMBODIMENTS

The implementation of the disclosure is described in detail below through embodiments in combination with the accompanying drawings, so that persons skilled in the art can understand comprehensively about how the present disclosure applies its technical means to solve its problem and thus attain the corresponding technical effects. As long as they do not conflict, each embodiment of the present disclosure and the technical features thereof can be combined with each other, and the technical solutions formed thereby all fall within the scope of the present disclosure.

Figure 4A:
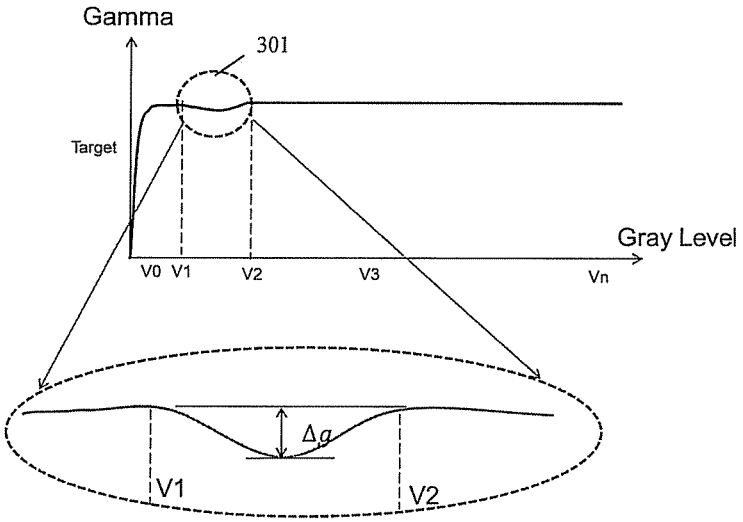
FIG. 4*a* and FIG. 4*b* show a principle for eliminating an uneven area in a Gamma curve.
Figure 4B:
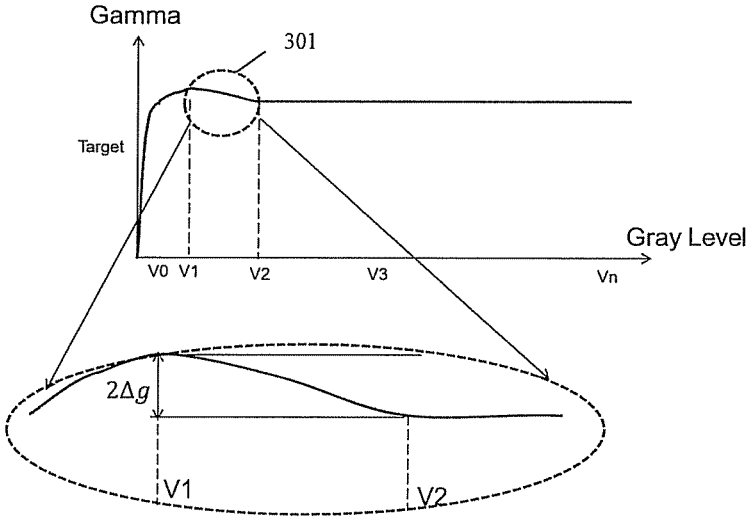

FIG. 4*a* and FIG. 4*b* show a principle of eliminating an uneven area in a Gamma curve.

Figure 1:
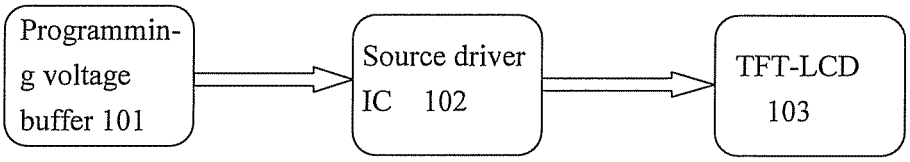
FIG. 1 shows how to adjust a Gamma curve of the LCD to be tested by adjusting an input grayscale voltage signal.
Figure 2:
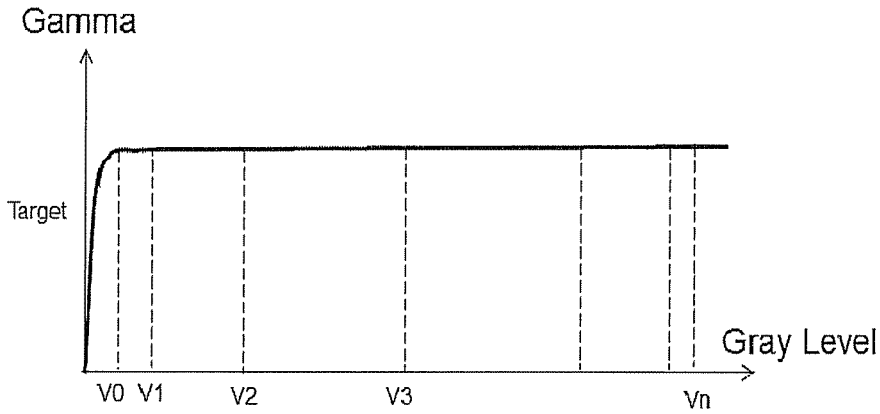
FIG. 2 shows a Gamma curve under a specific grayscale voltage.

The following description relates to how to obtain a Gamma curve. As shown in FIG. 1, the grayscale voltage values (V0-Vn) stored in a PVB 101 (programming voltage buffer) are sent to a source driver circuit 102 (Source IC) which drives the TFT-LCD to display the corresponding grayscale image according to the received grayscale voltage value. The Gamma curve between the brightness output information and the input grayscale voltage is obtained by capturing the grayscale image by, for example, the photodetector. The usual method is that the micro control unit compares the curve with a standard Gamma curve stored in the TFT-LCD to be tested. The grayscale voltage values (V0-Vn) stored in the programming voltage buffer are further adjusted based on the compared result. The above process is repeatedly performed until the Gamma curve of the displayed grayscale image matches with the standard Gamma curve, as shown in FIG. 2. The number of grayscale voltage inputs of the present disclosure is 1-255. However, the present disclosure is not limited to this, and the number of the grayscale voltages may be different according to the accuracy of the Gamma curve to be obtained or the performance requirements of LCD products.

Figure 3:
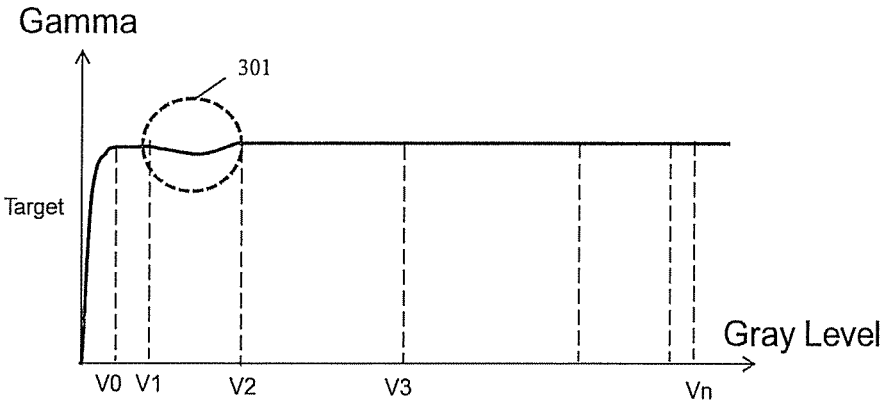
FIG. 3 shows an uneven area in a Gamma curve.

However, even if repeating adjustment-correction, the obtained Gamma curve approximately matches with the standard Gamma curve, the curve may have an uneven area 301 on some local portion as shown in FIG. 3. This will cause the display color cast or brightness abnormity.

FIG. 4*a* shows the uneven area 301 in an enlargement manner. There is a recess with a depth Δg on the corresponding Gamma curve between the grayscale voltage V1 and the grayscale voltage V2. In other word, the polarity of the slope of the Gamma curve in the section is changed.

The input grayscale voltage, for example, the grayscale voltage V1 is finely adjusted based on the depth Δg. For example, it is possible to calculate the multiples of Δg first, and then calculate a grayscale voltage increment ΔV corresponding to the multiples of Δg. The increment is superposed with the original V1, and the diagram shown in FIG. 4*b* can be obtained by observing the output. It can be seen that the original uneven area 301 becomes smooth. Although V1 can be seen to be slightly greater than the previous value from an output front end corresponding to the V1, the influence is not obvious for display.

Although only the uneven area 301 is show as a recess, it can be thought that the uneven area 301 can also represent the projected shape according to the different influences of manufacturing procedures during an actual process. Under this circumstance, the polarity of the slope of the corresponding Gamma curve between the grayscale voltages is changed. The corresponding grayscale voltage value at the place with the change is adjusted in the same manner, for eliminating the disadvantages.

The principle of the present disclosure is illustrated above, and the concept of the present disclosure is described in detail below in conjunction with examples. It should be noted that the examples are not intended to limit the present disclosure, but only for illustration, and after reading the content of the present disclosure, those skilled in the art can think of any alternative solution.

Figure 5:
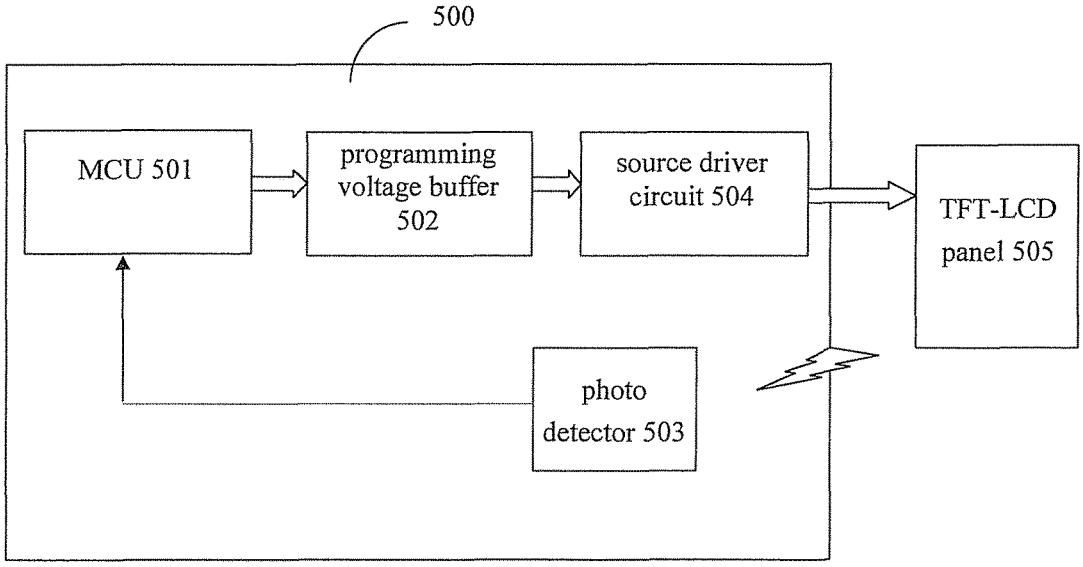
FIG. 5 shows a structure diagram of a device for adjusting a Gamma curve according to an example of the present disclosure.

FIG. 5 shows a structure diagram of a device 500 for adjusting a Gamma curve according to an embodiment of the present disclosure. In order not to obscuring the present disclosure, only the part related to the example is shown.

In the figure, the device 500 comprises, but is not limited to: a micro control unit 501, a photodetector 503, and a programming voltage buffer 502. In order to improve integration degree, a source driver circuit 504 can also be integrated with the above-mentioned units.

In the device 500, the photodetector 503 is used for capturing static or dynamic images. In the case that a TFT-LCD to be tested displays a grayscale image under a series of specific grayscale voltages, the photodetector 503 can obtain the grayscale image, perform proper processing and then send the grayscale image to the micro control unit 501.

The micro control unit 501 is communicatively connected with the photodetector 503. Firstly, the micro control unit 501 decodes standard grayscale image data and then drives the TFT-LCD 505 to be tested by virtue of the source driver circuit, and the TFT-LCD to be tested 505 displays a standard grayscale image, wherein the standard grayscale image includes all grayscales required in Gamma curve detection on the TFT-LCD.

Then, the micro control unit 501 can configure the photodetector 503 to be in a video image acquisition mode and request the photodetector 503 to start to get video image data. The photodetector 503 receives a request command of the micro control unit 501, then acquires the video image data showing the standard grayscale image of the TFT-LCD to be tested, and transmits the data into the buffer area of the micro control unit 501 after the acquisition.

If the processed grayscale image sent by the photodetector 503 is transmitted to the micro control unit 501, the micro control unit calculates grayscale information corresponding to the image which includes a brightness output value. If there are 0-255 grayscale voltage inputs, then 0-255 brightness output values can be correspondingly obtained, and a Gamma curve is obtained according to the corresponding relationship.

An uneven area in the Gamma curve can be determined according to the grayscale information corresponding to two adjacent grayscale voltages. Next, the depth value of the uneven area is calculated, the amplitude of any one or both of the two adjacent grayscale voltages is further adjusted based on the depth so that the Gamma curve between the two adjacent grayscale voltages is even.

The programming voltage buffer 502 is connected with the micro control unit, for receiving and storing the adjusted grayscale voltage value, so as to provide the adjusted grayscale voltage value to the source driver circuit.

In the embodiments of the present disclosure, in order to ensure the accuracy of the image acquired by the photodetector 503, the micro control unit 501, the photodetector 503 and the LCD to be tested 505 are arranged in a dark box so as to shield from an external light source. Further, the micro control unit 501 can be arranged in the master control circuit board. By placing the micro control unit 501, the photodetector 503 and the LCD to be tested 505 in a dark box, the external light source can be shielded, which is more advantageous for ensuring the accuracy of the image acquired by photodetector.

Figure 6:
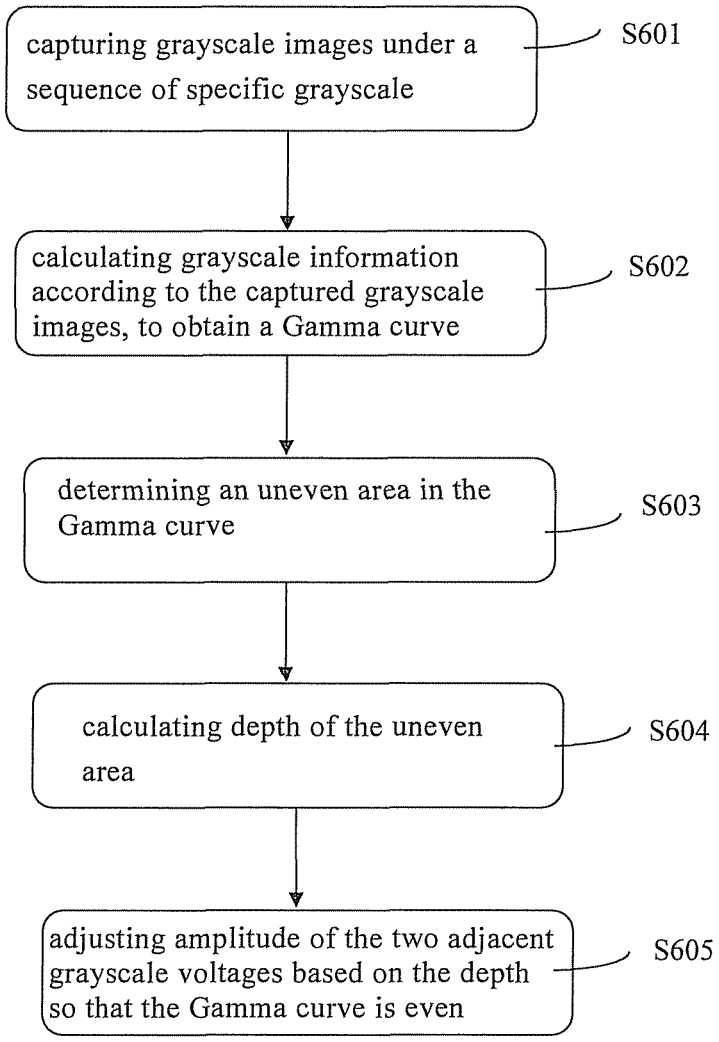
FIG. 6 shows a flow chart of a method for adjusting a Gamma curve according to an example of the present disclosure.

FIG. 6 shows a flow chart of a method for adjusting a Gamma curve according to one embodiment of the present disclosure.

In step S601, the grayscale images displayed by the TFT-LCD to be tested under a series of specific grayscale voltages are captured. In the embodiment of the present disclosure, the TFT-LCD 505 to be tested can be focused according to the video dynamic image data thereof, which is acquired by the photodetector 503 at first, and then the static image data of the TFT-LCD to be tested is acquired by the photodetector 503. The static image data may be the above-mentioned grayscale image. The grayscale image is generated by the micro control unit 501 according to a grayscale input voltage corresponding to the stored standard Gamma curve. The grayscale voltage value can be initially adjusted or not adjusted.

In step S602, the grayscale information corresponding to the image is calculated according to the captured grayscale image, so as to obtain a Gamma curve. If the grayscale voltage value is initially adjusted, then the Gamma curve is a curve which is initially adjusted. Because an initial adjustment cannot eliminate the local uneven area, a further fine adjustment is needed. The next operation functions as fine adjustments.

In step S603, the uneven area 301 in the Gamma curve is determined based on the grayscale information of the two adjacent grayscale voltages. In one embodiment, the uneven area 301 is determined based on whether the slope of the Gamma curve between the two adjacent grayscale voltages has a polarity change or not.

In step S604, the depth $\Delta g$ of the uneven area 301 is calculated.

In step S605, the amplitudes of any one or two of the two adjacent grayscale voltages (for example, V1 and V2) are further adjusted based on the depth $\Delta g$ so that the Gamma curve between the two adjacent grayscale voltages is even.

In an example, the amplitude of the smaller one of the two adjacent grayscale voltages is adjusted so that the slope of the Gamma curve between the two adjacent grayscale voltages does not have a polarity change.

According to the embodiments of the present disclosure, the amplitude of the smaller one of the two adjacent grayscale voltages is preferably adjusted, so that the correspondingly generated brightness output value equals to the original brightness output value plus the multiples of the depth value $\Delta g$, and thus the polarity of the slope of the Gamma curve between the two adjacent grayscale voltages is not changed.

The foregoing are merely preferred specific embodiments, but the present disclosure is not limited to this. Any changes or modifications made by persons skilled in the art will fall within the scope of the present disclosure. Accordingly, the scope of the present disclosure will be defined in the accompanying claims.

What is claimed:

1. A method for adjusting a Gamma curve of TFT-LCD, comprising:

capturing grayscale images of the TFT-LCD to be tested which are displayed under a series of specific grayscale voltages;

calculating grayscale information corresponding to the images according to the captured grayscale images, so as to obtain a Gamma curve;

determining an uneven area in the Gamma curve based on the grayscale information corresponding to two adjacent grayscale voltages, wherein the determining of the uneven area in the Gamma curve based on the grayscale information of said two adjacent grayscale voltages comprises determining the uneven area based on whether a slope of the Gamma curve between said two adjacent grayscale voltages changes in polarity or not;

calculating a depth of the uneven area; and further adjusting amplitude of any one or both of said two adjacent grayscale voltages based on the depth, so that the slope of the Gamma curve between the two adjacent grayscale voltages has no change in polarity.

2. The method as recited in claim 1, wherein the grayscale information in the grayscale images displayed under a series of the specific grayscale voltages comprises brightness output values corresponding to 0-255 grayscale voltages.

3. The method as recited in claim 1, wherein the amplitude of a smaller one of said two adjacent grayscale voltages is adjusted, so that the slope of the Gamma curve between said two adjacent grayscale voltages has no change in its polarity.

4. The method as recited in claim 3, wherein the amplitude of the smaller one of said two adjacent grayscale voltages is adjusted, so that brightness output value generated accordingly equals to the original brightness output value plus multiples of the depth value, and thus the slope of the Gamma curve between said two adjacent grayscale voltages have no change in its polarity.

5. A device for adjusting Gamma curve of a TFT-LCD, comprising:

a photodetector for capturing grayscale images of the TFT-LCD displayed under a series of specific grayscale voltages;

a micro control unit in communication with the photodetector for performing the following operations: calculating grayscale information corresponding to the images according to the captured grayscale images, to obtain a Gamma curve; determining an uneven area in the Gamma curve based on the grayscale information corresponding to two adjacent grayscale voltages; calculating depth of the uneven area, wherein the determining of the uneven area in the Gamma curve based on the grayscale information of said two adjacent grayscale voltages comprises determining the uneven area based on whether a slope of the Gamma curve between said two adjacent grayscale voltages changes its polarity or not; and further adjusting the amplitude of any one or both of the two adjacent grayscale voltages based on the depth so that the slope of the Gamma curve between the two adjacent grayscale voltages has no change in polarity; and a programming voltage buffer connected with the micro control unit, for receiving and storing the adjusted grayscale voltage value so as to provide the adjusted grayscale voltage value to a source driver circuit which is used for outputting the grayscale voltage.

6. The device as recited in claim 5, wherein the grayscale information in the grayscale images displayed under a series of the specific grayscale voltages comprises brightness output values aiming at 0-255 grayscale voltages.

7. The device as recited in claim 5, wherein the amplitude of a smaller one of said two adjacent grayscale voltages is adjusted, so that the slope of the Gamma curve between said two adjacent grayscale voltages has no change in its polarity.

8. The device as recited in claim 7, wherein the amplitude of the smaller one of said two adjacent grayscale voltages is adjusted, so that brightness output value generated accordingly equals to the original brightness output value plus multiples of the depth value, and the slope of the Gamma curve between said two adjacent grayscale voltages have no change in its polarity.

9. The device as recited in claim 5, wherein the micro control unit, the photodetector and the programming voltage buffer are arranged in a dark box.

10. The device as recited in claim 5, wherein the micro control unit is arranged in a master control circuit board of the TFT-LCD to be tested.

11. The device as recited in claim 6, wherein the micro control unit, the photodetector, and the programming voltage buffer are arranged in a dark box.

12. The device as recited in claim 5, wherein the micro control unit, the photodetector, and the programming voltage buffer are arranged in a dark box.

13. The device as recited in claim 7, wherein the micro control unit, the photodetector, and the programming voltage buffer are arranged in a dark box.

14. The device as recited in claim 8, wherein the micro control unit, the photodetector, and the programming voltage buffer are arranged in a dark box.

15. The device as recited in claim 6, wherein the micro control unit is arranged in the master control circuit board of the TFT-LCD to be tested.

16. The device as recited in claim 5, wherein the micro control unit is arranged in the master control circuit board of the TFT-LCD to be tested.

17. The device as recited in claim 7, wherein the micro control unit is arranged in the master control circuit board of the TFT-LCD to be tested.

18. The device as recited in claim 8, wherein the micro control unit is arranged in the master control circuit board of the TFT-LCD to be tested.

* * * * *